United States Patent [19]

Spatz

[11] 4,155,485

[45] May 22, 1979

[54] PUMP DEVICES FOR DISPENSING FLUIDS

[75] Inventor: Walter B. Spatz, Pacific Palisades, Calif.

[73] Assignee: Spatz Corporation, Venice, Calif.

[21] Appl. No.: 665,902

[22] Filed: Mar. 11, 1976

[51] Int. Cl.[2] ..... B05B 11/00

[52] U.S. Cl. ..... 222/179.5; 222/321; 222/340; 222/380; 222/381

[58] Field of Search ..... 222/321, 340, 182, 179.5, 222/387, 380; 239/331, 333, 329

[56] References Cited

U.S. PATENT DOCUMENTS

| | | | |
|---|---|---|---|
| 1,383,379 | 7/1921 | Blain | 222/390 |
| 1,676,358 | 7/1928 | Schott | 222/340 |
| 1,730,684 | 10/1929 | Phillips | 222/321 |
| 1,817,673 | 8/1931 | Buttner | 222/321 |
| 2,031,172 | 2/1936 | Maloney | 222/182 |
| 2,194,753 | 3/1940 | Inman | 222/321 |
| 3,257,961 | 6/1966 | Schlenker | 222/321 X |
| 3,471,065 | 10/1969 | Malone | 222/340 X |
| 3,777,945 | 12/1973 | Nozawa et al. | 222/394 |
| 3,792,800 | 2/1974 | Capra et al. | 222/340 |
| 3,797,748 | 3/1974 | Nozawa et al. | 239/324 X |

*Primary Examiner*—Robert J. Spar
*Assistant Examiner*—Frederick R. Handren
*Attorney, Agent, or Firm*—Subkow and Kriegel

[57] ABSTRACT

A spring actuated pump device is mounted on a container for fluid, the device including a pump chamber into which fluid from the container can flow, the spring forcing a cylinder structure against the fluid in the chamber to pressurize it, in order that opening of a finger actuated discharge valve will effect spraying of a desired quantity of fluid from the device, a suitable captive nut being swivelly mounted on the container against axial movement with respect thereto, the nut being threadedly connected to the cylinder structure to enable such structure to be shifted axially in response to rotation of the nut relative to the container and cylinder structure to compress the spring and store additional fluid pressurizing energy therein.

24 Claims, 7 Drawing Figures

PUMP DEVICES FOR DISPENSING FLUIDS

The present invention relates to devices for dispensing fluids from containers, and more particularly to pump devices adapted to be mounted on containers for dispensing fluids therefrom without the necessity for employing an aerosol propellant.

In my U.S. patent application, Ser. No. 752,105, filed Dec. 20, 1976, which is a continuation of Ser. No. 597,829, filed July 21, 1975, now abandoned, a pump device is disclosed which is mounted on a container for fluid. The pump device includes a housing structure mounted within and secured to the upper portion of the container and along which a hollow cylinder structure or movable fluid pressure applying structure is slidably axially. The inner wall of the cylinder structure is in slidable sealed relation with a piston or head, which may be fixed to or form part of the housing structure, the head being in communication with a suction tube extending into fluid in the container, for delivering fluid through the head and into the hollow portion of the cylinder structure thereabove, which provides a pump chamber. A check valve prevents return flow of the fluid from the chamber to the suction tube. A compression spring acts between the housing structure and cylinder structure to apply pressure to the fluid in the chamber and produce its discharge from the pump device when a dispensing valve mounted on the piston structure is opened. The cylinder structure is externally threaded for meshing with an internal thread in a cover or cap capable of enclosing the pump device and its valve, rotation of the cover on the cylinder structure to its fullest downward extent shifting the cylinder structure axially in the housing to compress the spring to its fullest extent.

In the above apparatus, it is necessary to thread the cover or cap on the cylinder structure to recompress the spring, and then remove the cover to expose the dispensing valve before fluid can be dispensed from the container and pump device. The spring cannot be recompressed in the absence of such threading of the cover onto the cylinder structure, nor can the spring expand and cause the cylinder structure to continually apply pressure to the fluid in the chamber unless the cover is first removed.

An objective of the present invention is to provide a pump device of the character described above, in which the spring can be reenergized without requiring an enclosure to be placed over the device and in threaded or cammed relation to it.

A further object of the invention is to provide a pump device of the character described above, in which the spring can be reenergized at any time while the dispensing valve of the device is exposed for use.

Another object of the invention is to provide a pump device of the character described above, in which the movable fluid pressure applying structure is visible to indicate its axial position with respect to the pump housing and the extent of dispensable fluid in the pump chamber; that is, whether the pump chamber is at its full fluid dispensing volume, partial fluid dispensing volume, or zero fluid dispensing volume. in a more limited sense, the fluid pressure applying structure has a visible portion projecting upwardly from the pump housing which contains a dispensing valve, the fluid pressure applying structure and its visible portion being movable axially of the pump housing to indicate the extent to which the pump chamber is filled with fluid.

Yet another object of the invention is to provide a pump device of the character described above, in which a spring actuator is threadedly meshed with the cylinder structure or movable fluid pressure applying structure of the device to enable the actuator to be rotated for the purpose of energizing the spring, the actuator remaining meshed with the cylinder structure without interfering with subsequent expansion of the spring and its movement of the cylinder structure or fluid pressure applying structure to maintain pressure on the fluid in the pump device. In addition, if desired, and as disclosed in one embodiment of the invention, a cap can be placed over the pump device and releasably coupled to the spring actuator to enable turning of the cap to rotate the actuator and effect axial movement of the cylinder structure or fluid pressure applying structure to energize the spring.

The spring actuator is swivelly mounted with respect to the pump device and container to permit its axial movement relative to the container, while permitting its rotation to axially feed the cylinder structure relative to the container and effect recompression of the spring. A steeply pitched threaded connection is provided between the spring actuator and cylinder structure to cause the axial movement of the cylinder structure in response to the force of the spring to freely reversely rotate the actuator, because of its swivel mounting with respect to the pump device and container.

This invention possesses many other advantages, and has other objectives which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings.

Figure 1:
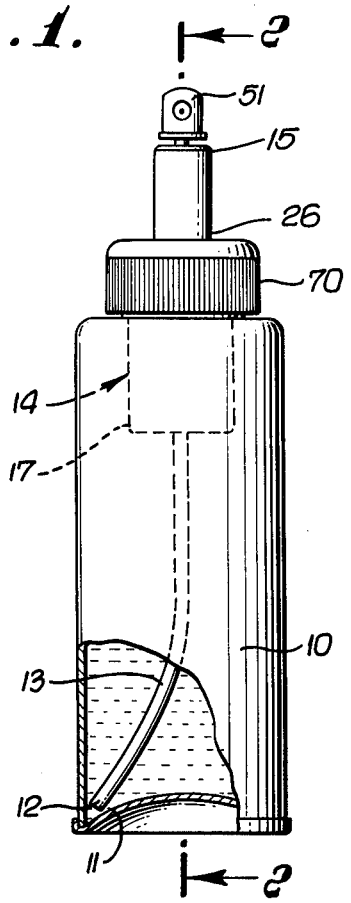
FIG. 1 is a side elevational view, with a portion broken away, of a bottle or container and a dispensing pump device mounted therein.

As disclosed in the drawings, a bottle or container 10 for fluids, such as hair sprays, deodorants, perfumes, and the like, has its bottom portion 11 preferably concaved, in order that the inlet end 12 of a dip or suction tube 13 can be disposed adjacent the lower end of the container wall, for the purpose of conducting liquid in the container upwardly to a pump device 14 suitably mounted on the container, a dispensing valve 15 being mounted on the upper portion of the pump device for the purpose of discharging a portion of the liquid under pressure in the pump device, preferably in a spray pattern.

Figure 2:
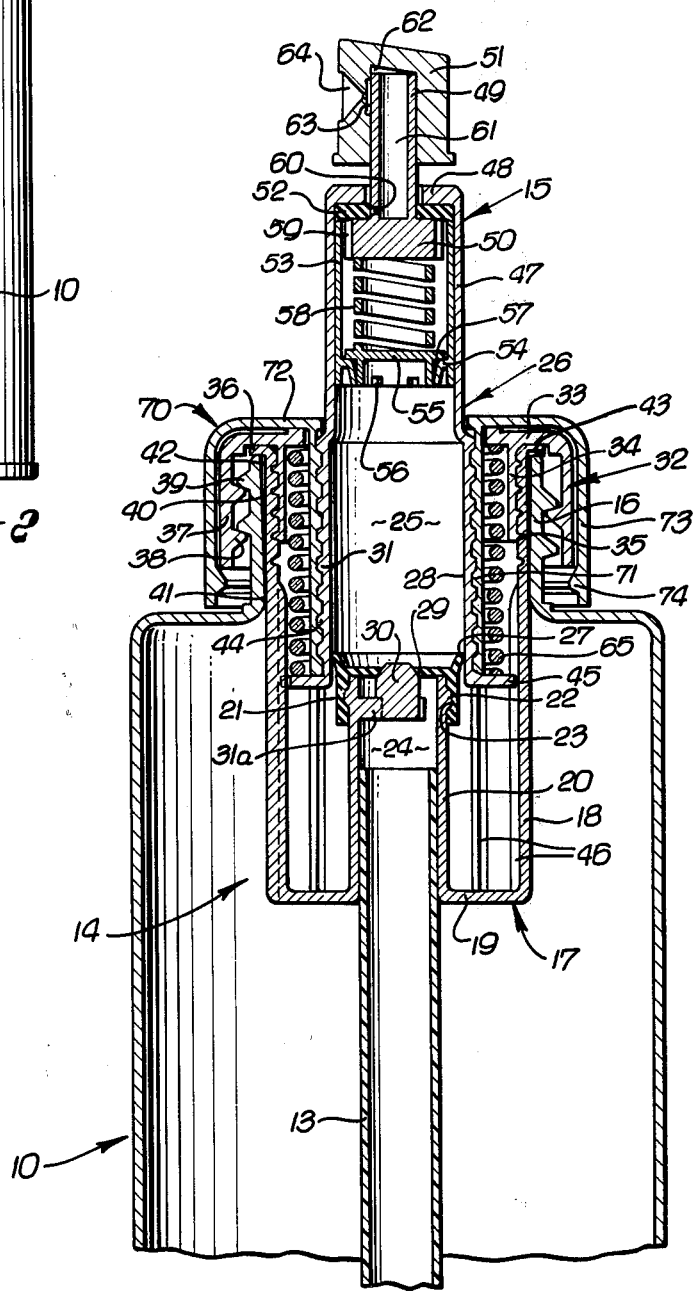
FIG. 2 is a longitudinal section, on an enlarged scale, of the upper portion of a container and pump device taken along the line 2—2 on FIG. 1, disclosing the spring, which effects pressurizing of fluid in the pump device, in its fully compressed condition.
Figure 3:
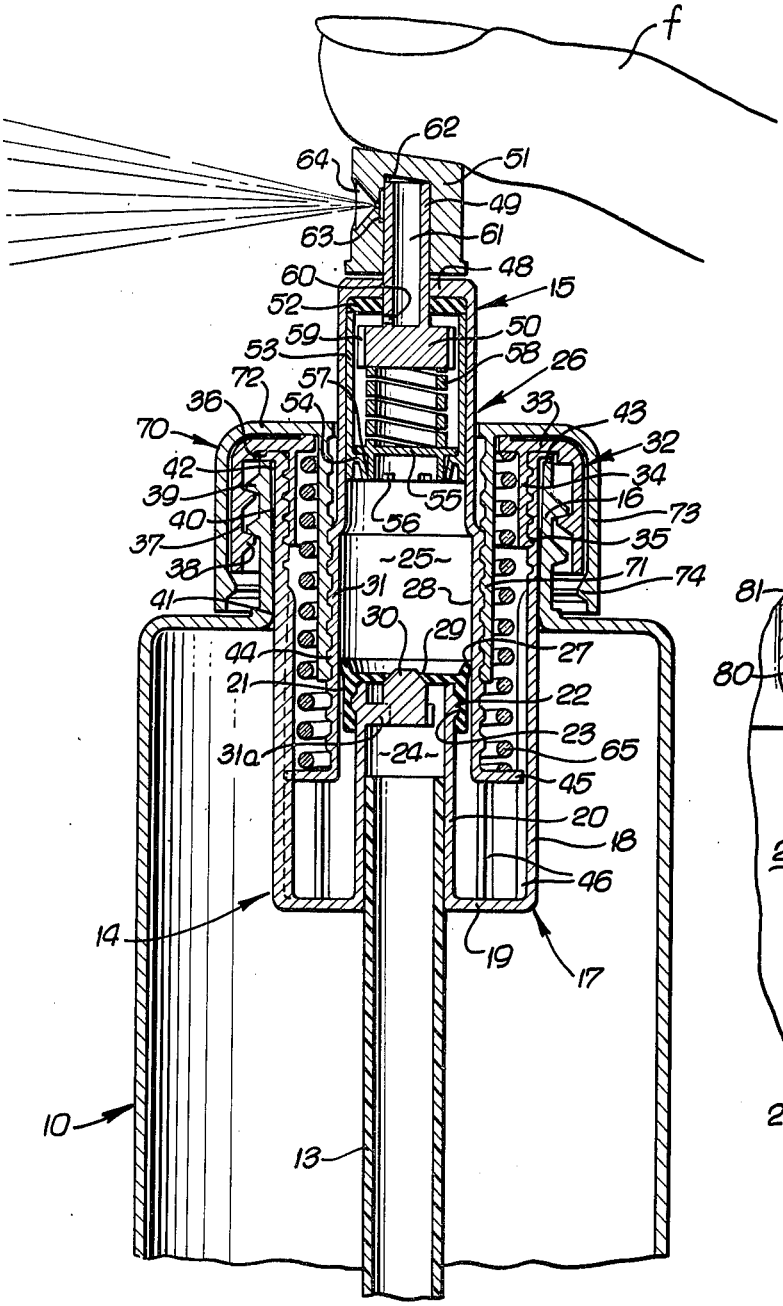
FIG. 3 is a view similar to FIG. 2 disclosing the spring partially expanded and the dispensing valve in an opened condition to spray a portion of the liquid from the apparatus.
Figure 7:
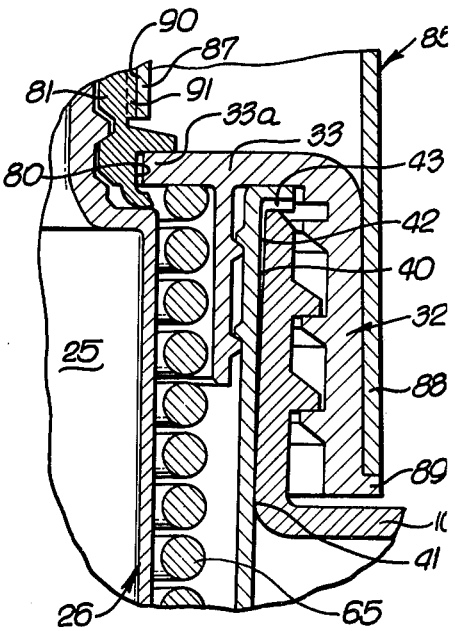
FIG. 7 is an enlarged fragmentary view of the relation between the pump device and neck of the container.

As disclosed in FIGS. 2 and 3, the container has an upper neck 16 of substantially smaller diameter than the main body of the container itself, through which the pump device 14 is mounted and to which the pump device is secured. The pump device includes a cylindrical housing 17 having an outer wall 18 merging into an annular bottom 19 which, in turn, merges into an inner wall 20 extending in spaced relation to the outer wall. This inner wall extends upwardly to a desired extent and has a suitable piston or head 21 mounted on its upper end, as by means of a peripheral rib 22 on the inner wall extending in a companion groove 23 in the head. The upper portion of the suction tube 13 extends within and is suitably fixed to the inner wall 20, and is capable of conducting fluid through an inner wall passage 24 and into a pump chamber 25 provided by a hollow cylinder structure or movable fluid pressure applying structure 26 mounted within and axially movable along the housing 17 and the head 21, in the manner described below.

The head has an upwardly extending outer lip seal 27 sealingly engaged against the inner wall 28 of the cylinder structure, the head also having an inner seal 29 adapted to move downwardly into engagement with a valve seat 30 suitably secured in an arm 31*a* extending inwardly from the inner housing wall 20. When a subatmospheric pressure is developed within the pump chamber 25, the liquid within the container will be sucked upwardly through the suction or dip tube 13, elevating the inner head seal 29 from its valve seat 30 to permit fluid to pass into the pump chamber. Return flow of fluid from the pump chamber is prevented by the inner seal portion 29 moving downwardly into sealing engagement with the valve seat 30, and also by the outer lip seal 27 bearing against the inner wall of the lower portion 31 of the cylinder structure 26.

The housing 17 is firmly secured to the container neck 16 by a cap or clamp nut 32. This cap includes a transverse base portion 33 from which an inner skirt 34 depends into the upper portion of the outer wall 18, the inner skirt having peripheral ribs 35 thereon adapted to be received in companion circumferential grooves in the outer wall 18 for the purpose of securing the cap 32 and housing together. The cap skirt 34 need merely be snapped into the outer wall 18 to effect attachment between these two parts, inasmuch as the housing and the cap are made of suitable plastic material that will permit the ribs 35 to deflect and then reexpand into the companion grooves in the outer wall 18. The inner skirt is moved inwardly into the outer wall to its fullest extent as determined by engagement of an outwardly directed flange 36 at the upper end of the outer wall with the transverse portion 33 of the cap.

The cap includes an outer skirt 37 having internal threads 38 adapted to mesh with companion external threads 39 on the container neck 16, so that insertion of the pump device and its outer wall 18 through the neck and into the container can be followed by rotation of the cap 32 for the purpose of threading it on the neck 16 and clamping the housing flange 36 between the upper end of the neck and the base portion 33 of the cap. Unthreading of the cap from the neck will permit the entire pump mechanism 14 to be removed, allowing the container 10 to be refilled with liquid through the open neck. The pump device can then be remounted through the neck and the cap 32 rethreaded on the neck for the purpose of firmly securing the housing 17 and container 10 to one another.

As liquid is sucked upwardly through the suction tube 13 into the pump chamber 25, as described hereinbelow, the pressure in the container decreases below atmospheric. Ambient air is permitted to enter the container to restore the pressure therewithin to substantially atmospheric. As disclosed in the drawing, the upper outer portion 40 of the outer wall is tapered from a location 41 near the lower end of the container neck 16 to the flange 36, providing an annular space 42 between the upper portion of the outer wall and the neck, circumferential sealing contact still being provided at the location 41 between the lower end of the neck and the periphery of the outer wall. One or more transverse grooves 43 are formed in the lower surface of the flange 36 to permit ambient air to enter the annular space 42. Because of the elasticity of the materials from which the housing 17 and container 10 are made, suction created within the container is sufficient to cause the outside atmospheric pressure to deform the outer wall 18 and neck 16 sufficiently as to disrupt the annular seal at 41 between the outer wall and the container neck, permitting atmospheric air to flow into the container. As the air pressure in the container returns to substantially atmospheric, the container neck and outer wall reengage to restore the annular seal at 41 between the parts, thereby preventing liquid from inadvertently leaking from the container.

The cylinder structure 26 includes the lower portion 31 disposed within the housing and which has the inner wall 28 against which the outer lip 27 seals, this lower portion having external threads 44 and terminating in a lower outwardly directed flange 45 extending substantially to the outer wall 18 of the housing. The outer wall has internal longitudinal splines 46 extending in companion grooves in the lower cylinder flange 45 to provide a slidable spline connection between the cylinder structure 26 and the housing 17. This arrangement prevents relative rotation between the parts 26, 17, but permits the cylinder structure to shift axially within the housing and along the head 21 secured to the upper portion of the inner wall 20.

The cylinder structure 26 also includes an upper portion 47 which projects upwardly beyond the container and which provides the cylinder chamber 25 in conjunction with the lower cylinder portion 31, this upper portion carrying the dispensing valve 15, which, as illustrated, is capable of being actuated by a person's finger f (FIG. 3). As disclosed, an upper cylinder head 48 is integral with the upper portion 47, extending inwardly toward a hollow valve stem 49 projecting from a valve head 50 below the cylinder head 48, and which extends upwardly beyond the cylinder head, the stem being disposed within and secured to a finger operated actuator 51. A suitable gasket 52 is clamped between the cylinder head 48 and a sleeve 53 suitably attached to the inner wall of the upper cylinder portion 47, this sleeve terminating in a lower inwardly directed portion 54 engaged by a spring seat 55. The spring seat has slots 56 therein communicating with a space 57 between the inwardly directed portion 54 and spring seat 55, in order that fluid from the chamber can flow through the slots 57 and pass into the sleeve 53.

The spring seat 55 may be formed integral with a helical compression spring 58 which engages the valve head 50 and urges it upwardly into sealing engagement with the gasket 52 to prevent discharge of fluid under pressure from the pump chamber 25. When the finger operated actuator 51 is depressed, the valve head 50 is removed from the gasket, as disclosed in FIG. 3, allowing the fluid under pressure to pass through the external grooves 59 in the valve head 50 and through an inlet port 60 in the stem to the passage 61 in the stem, which opens at its upper end into a space 62 within the finger operated actuator 51, there being sufficient clearance between the stem and the actuator for the fluid to pass into a passage 63 in the actuator and into a small discharge nozzle or port 64 in the actuator, to emerge from the actuator as a liquid spray.

A helical compression spring 65 is disposed around and between the lower portion 31 of the cylinder structure and the outer wall 18 of the cylindrical housing, the upper end of this spring bearing against the base 33 of the cap and the lower end against the cylinder flange 45, the spring tending to shift the cylinder structure 26 downwardly within the housing 17, thereby imposing pressure upon the liquid in the chamber 25. The spring 65 will expand whenever the dispensing valve 15 is opened, the downward movement of the cylinder structure along the head 21 decreasing the effective volume of the chamber 25 to maintain the liquid in the pump chamber under pressure. When the valve 15 is closed under the action of the valve spring 58, further expansion of the compression spring is prevented.

The spring 65 is compressed by elevating the cylinder structure 25 within the cylindrical housing 17. A spring actuator 70 in the form of a captive nut is provided which has an internally threaded sleeve 71 meshing with the external threads 44 on the cylinder structure 26, the sleeve being disposed within the helical compression spring 65. The upper end of the threaded sleeve 71 is integral with the base 72 of the captive nut which extends outwardly adjacent to the base 33 of the cap 32, merging into an outer skirt portion 73 encompassing the cap, and which terminates in an inwardly directed rib 74 underlying the lower end of the cap. The captive nut 70 is capable of rotating to effect a threading action of its sleeve 71 with respect to the cylinder structure 26, but it cannot move axially relative to the cap and the container because such axial movement is restrained by engagement of the captive nut with the base 33 of the cap 32 and by the rib 74 which extends under and closely adjacent to the lower end of the cap. Thus, a swivel connection is provided between the captive nut 70 and the container 10 and housing 17, so that rotation of the captive nut or actuator in the proper direction, as to the right, will, because of the threaded interconnection between the threaded sleeve and the cylinder structure, effect upward movement of the cylinder structure 26 within the housing 17 to compress the spring 65, the extent of upward movement being determined by engagement of the flange 45 with the lower end of the threaded sleeve 71, as disclosed in FIG. 2. As the cylinder structure moves upwardly along the stationary head 21, the effective volume of the pump chamber 25 increases to create a subatmospheric pressure therein, causing the liquid in the container to be sucked up the tube 13, past the valve member 29 and into the chamber.

When the dispensing valve 51 is shifted to an open position, the compressed spring is continuously urging the cylinder structure 26 downwardly to maintain the pressure of the cylinder structure of the liquid, so that the dispensing of the liquid from the discharge nozzle 15 can continue. Closing of the dispensing valve causes immediate cessation of the downward movement of the cylinder structure.

The captive nut or spring actuator 70 cannot move axially, as noted above. However, it is free to rotate or free-wheel during the dispensing of liquid from the apparatus, since the interengaging threads 44 and in 71 are steeply pitched, for example, at an angle of 45°. Accordingly, longitudinal movement of the spring 65 can shift the cylinder structure 26 downwardly and without rotation, the captive nut 70 merely free wheeling or rotating in a reverse direction to the direction of its turning in compressing the spring. The spring can shift the cylinder structure downwardly in the container to the extent determined by full expansion of the spring or by engagement of the flange 45 with the bottom 19 of the annular housing 17.

At any time, a person need merely grasp the captive nut 70 and rotate it to the right, in order to produce the upward feeding of the cylinder structure 26 with respect to the container 10 and recompression of the spring to its fullest extent, or, if desired, to only a partial extent.

Figure 4:
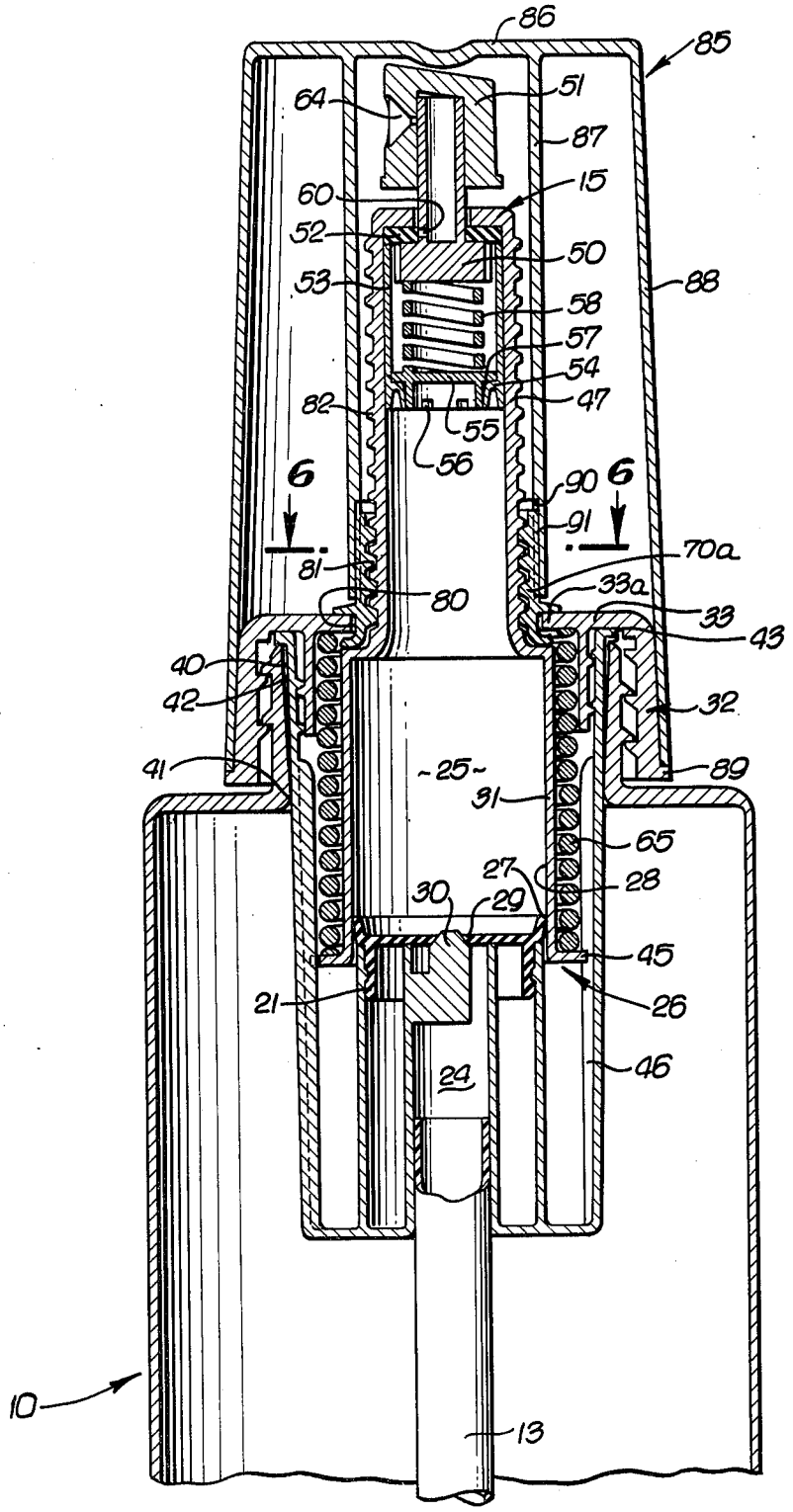
FIG. 4 is a view similar to FIG. 2 of another specific embodiment of the invention.
Figure 5:
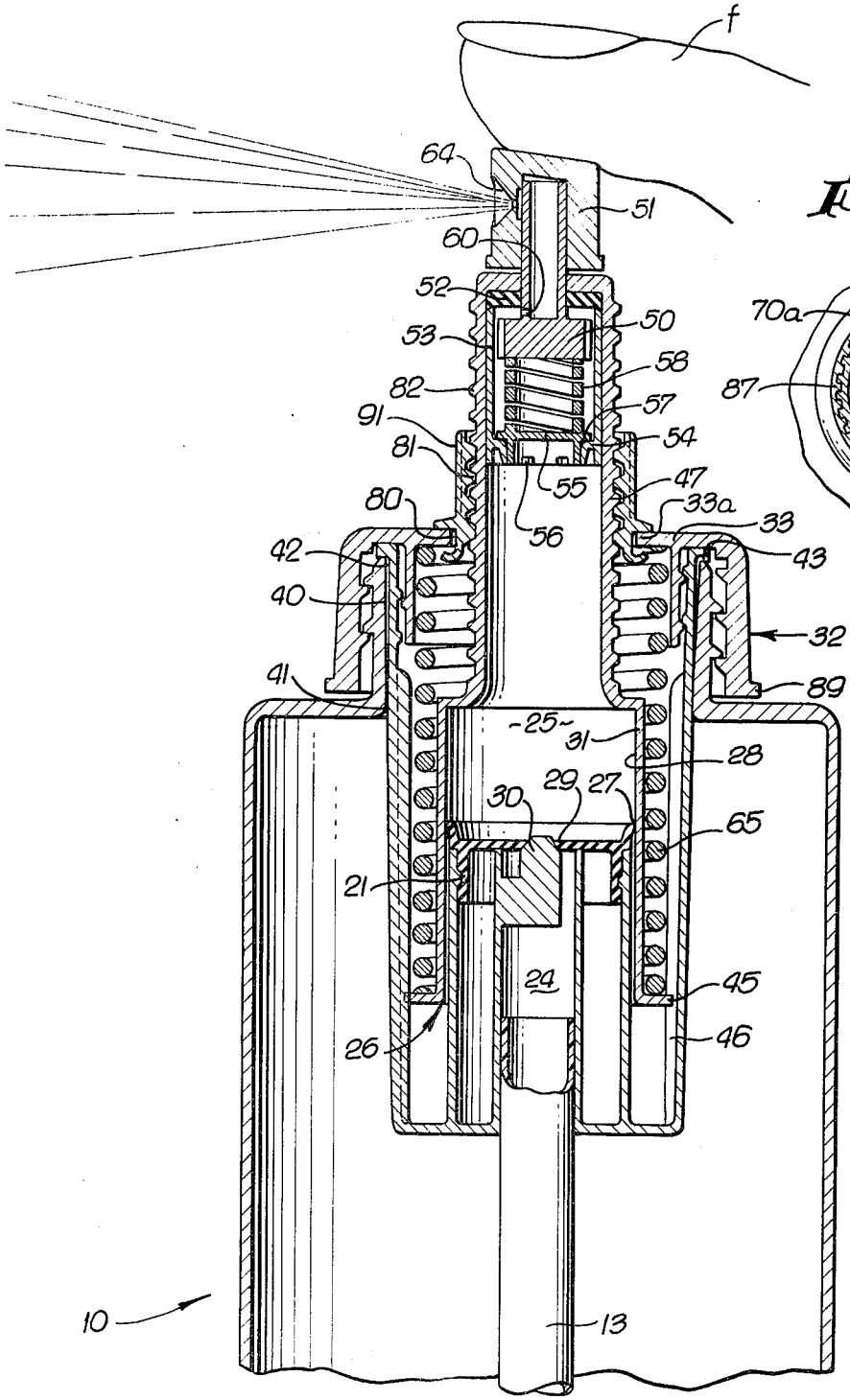
FIG. 5 is a view similar to FIG. 4 disclosing the spring partially expanded and the fluid being dispensed from the apparatus.
Figure 6:
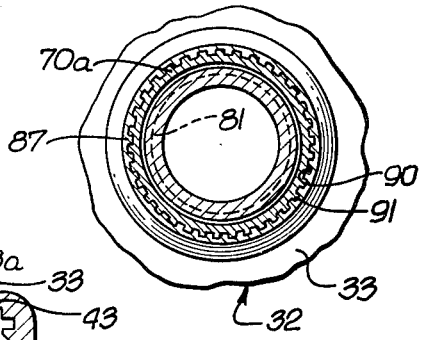
FIG. 6 is a cross section taken along the line 6—6 in FIG. 4.

The apparatus disclosed in FIGS. 4 and 5 operates in substantially the same manner as in the other form of the invention, the differences residing in providing a threaded connection between the upper portion 47 of the cylinder structure and an internally threaded captive nut **70*a*, which is prevented from moving axially by swivelly attaching it to the container cap 32. As specifically shown, the inner portion 33*a* of the cap base 33 extends into a circumferential groove 80 in the lower portion of the captive nut which surrounds the upper portion 47 of the cylinder structure. A threaded connection 81, 82 between the captive nut and upper portion of the cylinder structure is also steeply pitched, which enables the captive nut to be turned to the right and effect upward longitudinal feeding of the cylinder structure 26 within the housing 17 for the purpose of compressing the spring 65. When the dispensing valve 15 is opened, as by the action of a person's finger f (FIG. 5), the spring is permitted to expand to maintain the pressure on the liquid in the chamber 25**, the nut merely freewheeling or rotating in a reverse direction from the direction of movement of the nut in effecting compression of the spring.

As further disclosed in FIG. 4, the captive nut **70*a* can be rotated through use of a cover or cap 85 which encloses the external portion of the pump and dispensing valve mechanism, and also the cap 32. The cover includes an upper end 86 from which an inner skirt 87 and an outer skirt 88 extend, the outer skirt being adapted to be slipped around the exterior of the cap 32 until it engages the cap flange 89. The inner skirt 87 has internal splines 90 which are adapted to engage companion external splines 91 provided on the captive nut. Accordingly, when the cover 85 is placed over the apparatus, and with the inner skirt 87 disposed around the valve 15 and upper portion 47 of the cylinder structure, and in mesh with the captive nut 70*a*, turning of the cover to the right will correspondingly rotate the captive nut 70*a*, and the cylinder structure will move upwardly to compress the spring 65. The cover 85 need merely be moved longitudinally and without rotation from its splined connection to the nut 70*a* and off the cap 32, cylinder structure 26 and valve 15 for the valve 15 to be available for opening while pressure on the liquid in the chamber is maintained by the spring. In the absence of the cover 85, the captive nut 70***a*, can still be rotated to recompress the spring 65, as was pointed out above.

It is thus apparent that the threaded relationship between the captive nut and cylinder structure or fluid pressure applying structure can be maintained at all times, which facilitates recompression of the spring whenever desired merely by rotating the captive nut, but which does not prevent expansion of the spring as a result of dispensing fluid from the apparatus. The recompression of the spring can occur in the absence of a cover or, if desired, a cover can be used in rotating the captive nut in the appropriate direction, as disclosed in FIG. 4.

At any time, the captive nut 70 of the apparatus disclosed in FIGS. 2 and 3 can be forced from the container cap 32, as permitted by the elasticity of the materials from which the parts are made, and the cap 32 unthreaded from the neck of the bottle to remove the entire pump device therefrom and permit refilling of the bottle or container. In the form of invention disclosed in FIGS. 4 and 5, the captive nut 70*a* can remain in place, it only being necessary for the cover 85 to be removed and the cap 32 unthreaded from the neck of the bottle to remove the pump device and enable the bottle or container to be refilled.

It is noted that in connection with both forms of the invention, the neck portion 47 of the cylinder structure 26 projects above the captive nut 70 or 70*a* (FIGS. 3,5) when the dispensing device is to be used, resulting in visibility of the outer or neck portion 47. Such outer portion moves axially upwardly of the captive nut when the spring 65 is being compressed, and downwardly of the captive nut during discharge of fluid from the spray nozzle 64. While the dispensing valve 15 is closed, fluid is trapped in the chamber 25 and spring 65 is then incapable of shifting the cylinder structure donwardly of the captive nut and container 10. Accordingly, a person viewing the dispensing device with the cover 85 removed can determine, from the extent of upward projection of the outer or neck portion 47 from the captive nut 70 or 70*a*, the approximate extent to which the chamber 25 is filled with fluid. Assuming the neck portion 47 projects from the captive nut to its maximum extent, the chamber is full and the actuator need not be rotated to compress the spring 65, which is also true of the condition in which the outer or neck portion projects partially, but substantially, from the captive nut. Under both conditions the valve 15 need only be actuated for liquid to spray from the nozzle 64. If, however, the neck or outer portion 47 is disposed to a maximum extent within the captive nut, the spring 65 will have fully expanded. It is then necessary to rotate the captive nut to feed the cylinder structure upwardly to recompress the spring before using the dispensing device.

I claim:

1. A fluid dispensing device, comprising a container for the fluid adapted to be held in a person's hand, pump means mounted in said container including a housing fixed to said container and a cylinder in said housing shiftable with respect to said housing and container, said cylinder having a pump chamber therein and an external thread, means providing a slidable spline connection between the lower end of said cylinder and said housing to prevent rotation of said cylinder in said housing, said pump means including a member fixed in said container and disposed in said chamber in slidable sealed relation to said cylinder, spring means in said housing surrounding said cylinder and bearing against said lower end of said cylinder to shift said cylinder and its chamber in one direction with respect to said member to cause said cylinder to apply pressure to fluid in said chamber, a first valve means permitting fluid flow from said container into the lower end of said chamber, but preventing reverse fluid flow, an internally threaded actuator threadedly engaged with said external thread and rotatable in one direction with respect to said cylinder to store potential energy in said spring means and to effect fluid flow through said first valve means into said chamber, means preventing substantial axial movement in both directions of said actuator with respect to said container, and a second valve means operable by a finger of the hand holding said container to permit discharge of pressurized fluid from said pump chamber and through said cylinder in response to shifting of said cylinder and its chamber in said one direction by said spring means.

2. A device as defined in claim 1; said first preventing means comprising a swivel connection between said actuator and said container.

3. A device as defined in claim 1; and means for rotating said actuator in the reverse direction including said engaged threads on said actuator and cylinder.

4. A device as defined in claim 1; said threads being steeply pitched.

5. A device as defined in claim 1; said member being a stationary piston along which said cylinder is slidable in sealed relation thereto.

6. A device as defined in claim 1; said resilient means comprising a helical compression spring engaging said container and said cylinder.

7. A device as defined in claim 1, said cylinder having a visible portion thereof projecting upwardly beyond said actuator to provide an indication of the fluid volume in said pump chamber.

8. A device as defined in claim 7; said second valve means being mounted on said visible portion of said cylinder.

9. A fluid dispensing device, comprising a container for the fluid, pump means mounted in said container, said pump means including a fluid pressure applying structure shiftable with respect to said container and having a pump chamber therein, resilient means for shifting said fluid pressure applying structure and its chamber in one direction to cause said fluid pressure applying structure to apply pressure to fluid in said chamber, a first valve means permitting fluid flow from said container into said chamber, but preventing reverse fluid flow, means for energizing said resilient means including an actuator rotatable with respect to said fluid pressure applying structure and container, said actuator rotating in a forward direction to energize said resilient means and in a reverse direction in response to the deenergizing of said resilient means, means preventing substantial axial movement in both directions of said actuator with respect to said container, said energizing means further includes means interconnecting said actuator and fluid pressure applying structure to effect shifting of said fluid pressure applying structure and its chamber in the opposite direction in response to forward rotary movement of said actuator relative to said fluid pressure applying structure to store potential energy in said resilient means and to effect fluid flow through said first valve means into said chamber, a second valve means operable to permit discharge of pressurized fluid from said pump chamber in response to shifting of said fluid pressure applying structure in its chamber in said one direction by said resilient means, means for rotating said actuator in said reverse direction in response to shifting of said fluid pressure applying structure by said resilient means in said one direction, an enclosure adapted to enclose said second valve means, and means releasably connecting said enclosure to said actuator to transmit rotation of said enclosure to said actuator.

10. A fluid dispensing device, comprising a container for the fluid, pump means mounted in said container, said pump means including a fluid pressure applying structure shiftable with respect to said container and having a pump chamber therein, resilient means for shifting said fluid pressure applying structure and its chamber in one direction to cause said fluid pressure applying structure to apply pressure to fluid in said chamber, a first valve means permitting fluid flow from said container into said chamber, but preventing reverse fluid flow, means for energizing said resilient means including an actuator rotatable with respect to said fluid pressure applying structure and container, means preventing substantial axial movement in both directions of said actuator with respect to said container, said energizing means further including means interconnecting said actuator and fluid pressure applying structure to effect shifting of said fluid pressure applying structure and its chamber in the opposite direction in response to movement of said actuator relative to said fluid pressure applying structure to store potential energy in said resilient means and to effect fluid flow through said first valve means into said chamber, and a second valve means operable to permit discharge of pressurized fluid from said pump chamber in response to shifting of said fluid pressure applying structure and its chamber in said one direction by said resilient means; an enclosure adapted to enclose said second valve means, a releasable connection between said enclosure and actuator to transmit rotation of said enclosure to said actuator, said interconnecting means comprising a thread on said actuator meshing with a thread on said fluid pressure applying structure whereby rotation of said actuator on said fluid pressure applying structure shifts said fluid pressure applying structure longitudinally to energize said resilient means.

11. A fluid dispensing device, comprising a container for the fluid, pump means mounted in said container, said pump means including a tubular fluid pressure applying structure shiftable with respect to said container and having a pump chamber therein, resilient means for shifting said fluid pressure applying structure and its chamber in one direction to cause said fluid pressure applying structure to apply pressure to fluid in said chamber, a first valve means permitting fluid flow from said container into said chamber, but preventing reverse fluid flow, means for energizing said resilient means including an actuator rotatable with respect to said fluid pressure applying structure and container, said actuator rotating in a forward direction to energize said resilient means and in a reverse direction in response to the deenergizing of said resilient means, means preventing substantial axial movement in both directions of said actuator with respect to said container, said energizing means further including means interconnecting said actuator and fluid pressure applying structure to effect shifting of said fluid pressure applying structure and its chamber in the opposite direction in response to forward rotary movement of said actuator relative to said fluid pressure applying structure to store potential energy in said resilient means and to effect fluid flow through said first valve means into said chamber, a second valve means operable to permit discharge of pressurized fluid from said pump chamber and through said tubular fluid pressure applying structure in response to shifting of said fluid pressure applying structure and its chamber in said one direction by said resilient means, means for rotating said actuator in said reverse direction in response to shifting of said fluid pressure applying structure by said resilient means in said one direction, an enclosure adapted to enclose said second valve means, and means releasably connecting said enclosure to said actuator for transmitting rotation of said enclosure to said actuator, said interconnecting means comprising a thread on said actuator meshing with a thread on said fluid pressure applying structure, whereby rotation of said actuator on said fluid pressure applying structure and container shifts said fluid pressure applying structure longitudinally to energize said resilient means, said threads being steeply pitched, said enclosure being removable from said actuator to expose said second valve means, said resilient means comprising a helical spring engaging said container and said fluid pressure applying structure.

12. A device as defined in claim 11; said second valve means being mounted on said fluid pressure applying structure and having a passage communicating with said chamber.

13. A fluid dispensing device, comprising a container for the fluid and having a neck, a pump housing structure in said neck and releasably secured to said neck, a cylinder structure slidable longitudinally in said housing structure and having a chamber therein, a member fixed to said housing structure and disposed in said chamber in slidable sealed relation to said cylinder structure, spring means surrounding said cylinder structure and engaging said cylinder structure and housing structure for shifting said cylinder structure and its chamber in one direction to cause said cylinder structure to pressurize fluid in said chamber, an inlet valve in said container permitting fluid flow from said container to said chamber, but preventing reverse fluid flow, a discharge valve on said cylinder structure communicating with said chamber, an actuator rotatable with respect to said cylinder structure and container is forward and rearward directions, first means preventing substantial axial movement in both directions of said actuator with respect to said container, second means preventing relative rotation between said cylinder structure and housing structure while permitting said cylinder structure to shift axially of said member, and means interconnecting said actuator and cylinder structure for shifting said cylinder structure in the opposite direction to energize said spring means in response to rotation of said actuator with respect to said cylinder structure.

14. A device as defined in claim 13; said preventing means comprising a swivel connection between said actuator and said container.

15. A device as defined in claim 13; said interconnecting means comprising a helical thread on said actuator meshing with a helical thread on said cylinder structure, whereby rotation of said actuator with respect to said cylinder structure shifts said cylinder structure longitudinally in said opposite direction.

16. A device as defined in claim 13; said first preventing means comprising a swivel connection between said actuator and said container, said interconnecting means comprising a helical thread on said actuator meshing with a helical thread on said cylinder structure whereby rotation of said actuator with respect to said cylinder structure shifts said cylinder structure longitudinally in said opposite direction.

17. A device as defined in claim 13; said first preventing means comprising a swivel connection between said actuator and said container, said interconnecting means comprising a helical thread on said actuator meshing with a helical thread on said cylinder structure, whereby rotation of said actuator with respect to said cylinder structure shifts said piston structure longitudinally in said opposite direction, said spring means comprising a helical spring compressed between said housing structure and cylinder structure.

18. A device as defined in claim 13; said interconnecting means comprising a helical thread on said actuator meshing with a helical thread on said cylinder structure, whereby forward rotation of said actuator with respect to said cylinder structure shifts said cylinder structure longitudinally in said opposite direction, said threads being steeply pitched, whereby longitudinal shifting of said cylinder structure in said one direction rotates said actuator in said rearward direction.

19. A device as defined in claim 13; said first preventing means comprising a swivel connection between said actuator and said container, said interconnecting means comprising a helical thread on said actuator meshing with a helical thread on said cylinder structure, whereby rotation of said actuator with respect to said cylinder structure shifts said cylinder structure longitudinally in said opposite direction, said threads being steeply pitched, whereby longitudinal shifting of said cylinder structure in said one direction rotates said actuator in said rearward direction.

20. A device as defined in claim 13; said member having an opening into said chamber through which fluid flowing through said inlet valve can pass into said chamber.

21. A device as defined in claim 13; an enclosure adapted to enclose said discharge valve, and means releasably connecting said enclosure to said actuator.

22. A device as defined in claim 13; said cylinder structure having a visible portion thereof projecting upwardly beyond said actuator to provide an indication of the fluid volume in said chamber.

23. A device as defined in claim 22; said discharge valve means being mounted on said visible portion to permit the discharge of pressurized fluid from said chamber.

24. A fluid dispensing device, comprising a container for the fluid and having a neck, a pump housing structure in said neck and releasably secured to said neck, a cylinder structure slidable longitudinally in said housing structure and having a chamber therein, spring means engaging said cylinder structure and housing structure for shifting said cylinder structure and its chamber in one direction to cause said cylinder structure to pressurize fluid in said chamber, an inlet valve in said container permitting fluid flow from said container to said chamber, but preventing reverse fluid flow, a discharge valve on said cylinder structure communicating with said chamber, an actuator rotatable with respect to said cylinder structure and container, means preventing substantial axial movement in both directions of said actuator with respect to said container, and means interconnecting said actuator and cylinder structure for shifting said cylinder structure in the opposite direction to energize said spring means in respone to rotation of said actuator with respect to said cylinder structure, an enclosure adapted to enclose said discharge valve, and a releasable connection between said enclosure and actuator to transmit rotation of said enclosure to said actuator, said interconnecting means comprising a thread on said actuator meshing with a thread on said cylinder structure, whereby rotation of said actuator on said cylinder structure shifts said cylinder structure longitudinally to energize said spring means.

* * * * *